US005369826A

United States Patent [19]

Ikeda

[11] Patent Number: 5,369,826

[45] Date of Patent: Dec. 6, 1994

[54] BOTTOM STRUCTURE OF A BED

[75] Inventor: Yasuhiro Ikeda, Tokyo, Japan

[73] Assignee: Paramount Bed Company Limited, Tokyo, Japan

[21] Appl. No.: 60,997

[22] Filed: May 14, 1993

[51] Int. Cl.[5] ..... A61G 7/04

[52] U.S. Cl. ..... 5/613; 5/618; 5/465; 5/191

[58] Field of Search ..... 5/613, 617, 618, 900, 5/401, 465, 180, 191

[56] References Cited

U.S. PATENT DOCUMENTS

| | | | |
|---|---|---|---|
| 3,599,963 | 1/1971 | Grover | 5/613 X |
| 3,763,507 | 10/1973 | Propst | 5/618 X |
| 4,275,473 | 6/1981 | Poirier | 5/465 X |
| 4,370,767 | 2/1983 | Fraser | 5/419 X |
| 4,662,851 | 4/1987 | Foster | 5/765 X |
| 4,824,411 | 4/1989 | McClanahan | 5/465 X |

FOREIGN PATENT DOCUMENTS

| | | |
|---|---|---|
| 51-30716 | 9/1976 | Japan . |
| 54-26164 | 8/1979 | Japan . |
| 54-37594 | 11/1979 | Japan . |

*Primary Examiner*—Michael F. Trettel
*Attorney, Agent, or Firm*—Townsend & Banta

[57] ABSTRACT

A bottom structure of a bed having a bottom formed so as to be bendable by a series of parallel strips mutually sequentially connected such that the strips are shorter in width on the side away from the sequentially connected side. In this way the bottom structure of the bed allows a portion of a bed bottom to be bent in a large curvature, thus is provided a bed which is comfortable and highly adaptable for patients of various body sizes.

15 Claims, 3 Drawing Sheets

FIG. 4
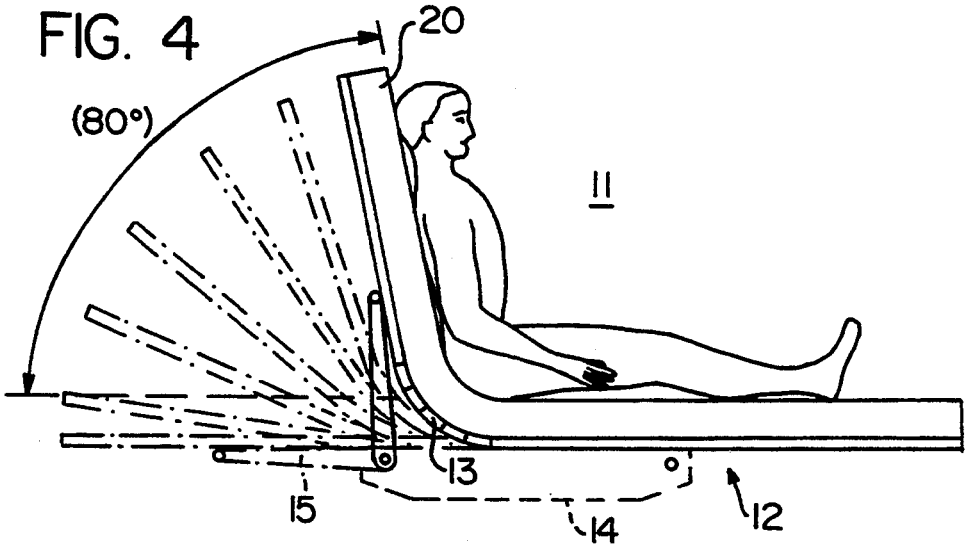
FIG. 5
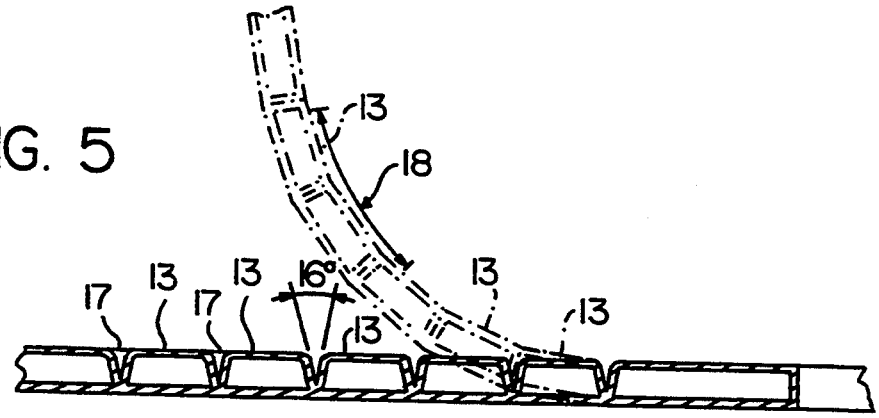
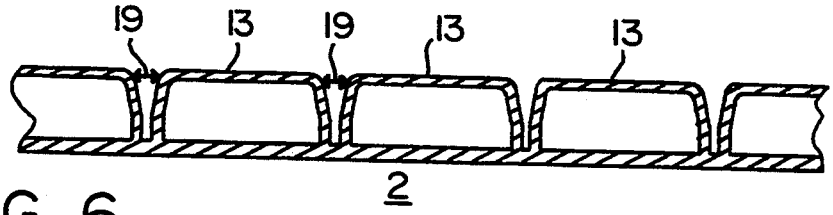
FIG. 6

FIG. 7
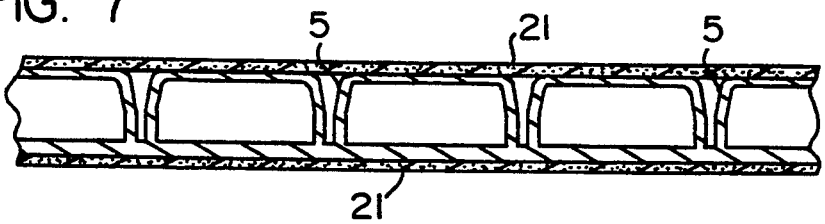
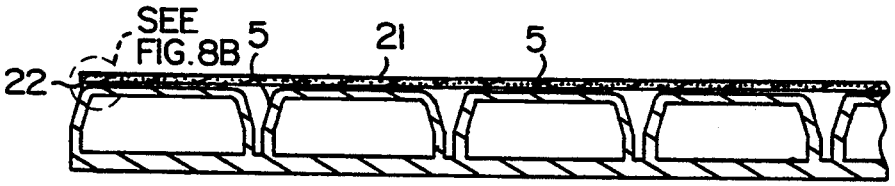
FIG. 8A
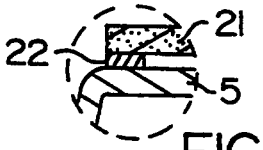
FIG. 8B
FIG.9A
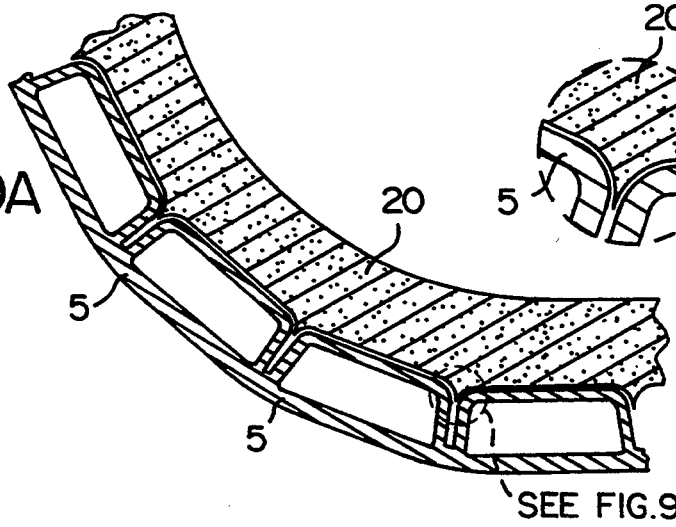
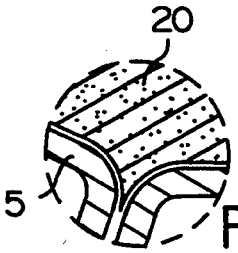
FIG.9B

BOTTOM STRUCTURE OF A BED

BACKGROUND OF THE INVENTION

1. Field of the Invention

The present invention relates to a bottom structure of a bed which allows the bottom to be bent upward, forming a large curvature such that it does not cause a patient to feel any discomforting pressure. The present invention also relates to a bottom structure of a bed which allows a patient to experience minimum physical discomfort irrespective of his body size when the bottom structure of a bed is bent, forming a large curvature in the leg portion corresponding to the leg or knee position of the patient or forming a large curvature in the waist position of the patient.

2. Description of the Related Art

In many recent beds, the bottom structure is divided into a back portion, waist portion, leg portion, etc. to allow the back portion and/or the leg portion to be raised by a drive. In these beds the bottom structure can be bent upward to alter the position of the back portion or knee portion, using various mechanisms.

An ordinary bed structure has a waist portion and a leg portion simply joined. It can happen that the joint between the waist portion and the leg portion does not fit or suit the knee position of the patient whose body size does not conform to a standard bed, as a result one can feel physical discomfort when the leg portion of the bed is raised. To overcome this various beds having different positions of the bottom joint are required to be prepared.

An ordinary bed structure can also have a back portion and a waist portion simply joined. The joint acts as a pivot for the back portion, when raising and lowering the back portion. Therefore, as the back portion is raised to a certain angle, the space formed near the joint between the back portion and the waist portion becomes narrow. As a result, the waist and abdominal region of the patient are uncomfortably pressed by the mattress, which is bent at an angle.

SUMMARY OF THE INVENTION

The present invention has been completed to overcome the problems cited above. An object of the present invention is to provide a bottom structure of a bed which allows the leg portion to be raised, without causing any patient to feel physical discomfort. Another object of the present invention is to provide a bottom structure of a bed designed to allow bending the bottoms structure in a large curvature forming a curved space at the bend without causing a patient to feel pressure.

The present invention provides a bottom structure of a bed, comprising a leg portion of a bottom, being formed to be bendable by a series of parallel strips mutually sequentially connected on the upper side, and each of the strips, being shorter in width on the under side than on the upper side.

The present invention also provides a bottom structure of a bed, comprising a back and/or waist portion, being formed to be bendable by a series of parallel strips mutually sequentially connected on the bottom or under side, and each of the strips, being shorter in width on the under side than on the upper side.

Furthermore, in the bottom structure, the parallel strips of the leg portion are formed by thermoplastic molding as hollow strips mutually sequentially connected on the upper or under side, with gaps formed between the respective adjacent strips on the side away from the connected side.

If the leg portion is raised, the respective parallel strips are brought into mutual contact on the under side, and as a result, the leg portion corresponding to the leg position of the patient is bent and protrudes upward.

If the bottom is bent upward to raise the back portion, the respective parallel strips are brought into mutual contact on the upper side. Thus the portion of the bottom corresponding to the waist of the patient is bent in a large curvature. So, the space formed at the bent portion of the bottom, corresponds to the patient and causes minimum feeling of pressure.

BRIEF DESCRIPTION OF THE DRAWINGS

FIG. 4 is a side illustration showing an essential region of a bed having a bottom structure with a back portion of the present invention.

FIG. 5 is an enlarged side view showing a cross section of the back portion shown in FIG. 4.

FIG. 6 is an enlarged side view showing a cross section of the back portion of another embodiment.

FIG. 7 is an illustration showing a bottom structure of a bed where the bottom is covered with a flexible sheet.

FIG. 8 is an illustration showing a bottom structure of a bed where a flexible sheet is laid on the upper side of the bottom structure.

FIG. 9 is an illustration showing a bottom structure of a bed where a mattress (or other material) is caught in the bottom structure.

DETAILED DESCRIPTION OF THE INVENTION

The bottom structure of a bed according to one embodiment of tile present invention, is designed to allow the leg portion of a bed bottom, corresponding to the leg position of a patient, to be bent at a large curvature. The leg portion of a bed bottom corresponding to the leg position of the patient is formed by parallel strips, which allow bending. The parallel strips are preferably formed by thermoplastic molding hollow strips. The parallel strips are preferably almost trapezoidal in cross section and are sequentially connected on the upper side, with gaps formed between the respectively adjacent parallel strips on the under side. The leg portion may be provided with a leg portion raising mechanism, which raises the leg portion using a support arm. Thus is provided a bed which is highly adaptable for patients of various body sizes.

The bottom structure of a bed according to another embodiment of the present invention, is designed to allow a bed bottom to be bent upward in a large curvature, thus providing a bed which allows back formation without causing a patient to feel any displeasing pressure. A bottom is formed by using parallel strips at the portion corresponding to the waist of the patient, to allow being upward. The number of parallel strips is preferably five, and they are preferably formed by thermoplastic molding hollow strips. The parallel strips are preferably almost trapezoidal in cross section, to form gaps with an angle of about 16 degrees between the respectively adjacent faces of the parallel strips on the upper side. The bottom is provided with a back raising mechanism for bending the bottom upward through a support arm. Thus is provided a comfortable bed designed to ease the feeling of pressure caused to a patient by back raising action.

The bottom structure of a bed according to yet another embodiment of the present invention, includes a flexible sheet. If a bottom structure has gaps on the upper side, when it is bent, mattress material or other covering material can be caught between the parallel strips. One way to minimize material being caught in the gaps and reduce interference with the bottom structure, is to insert a flexible bottom sheet. This sheet prevents material from interfering with the operation of the bottom structure and reduces the collection of dust and dirt in the gaps of the bottom structure as well.

The bottom structure of a bed of the present invention is described below in reference to the figures shown in the attached drawings.

Figure 1:
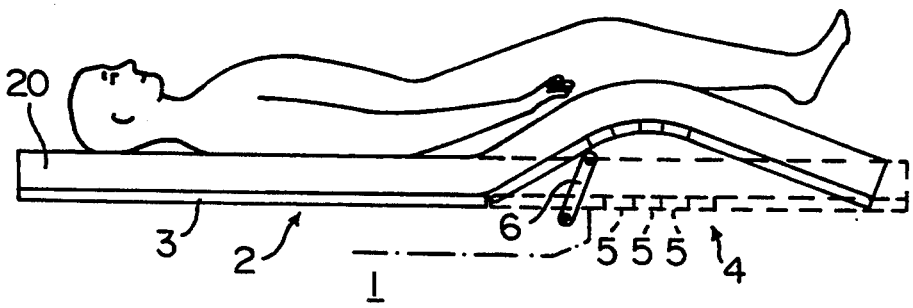
FIG. 1 is a side illustration showing an essential region of a bed having a bottom structure with a leg portion according to the present invention.

As shown in FIG. 1, in a bed (1), a bottom (2) is divided into a back portion (3) and a leg portion (4) corresponding approximately to the leg position of the patient. The leg portion (4) is formed by parallel strips (5) to allow bending, and the parallel strips are sequentially mutually connected on the upper side. Each of the parallel strips is shorter in width on the under side than on tile upper side.

Figure 2:
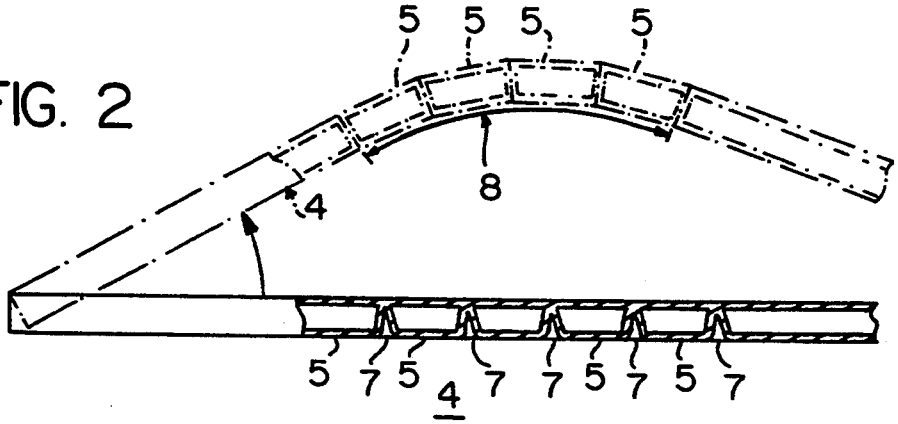
FIG. 2 is an enlarged side view showing a cross section of the leg portion shown in the FIG. 1.

The parallel strips (5) of the leg portion (4) are preferably formed by thermoplastic molding hollow strips almost trapezoidal in cross section as shown in FIG. 2, and sequentially connected on the upper side, with gaps (7) formed between the respectively adjacent parallel strips (5) on tile under side. Under the leg portion (4), a leg portion raising mechanism is provided to bend the leg portion upward by a support arm (6). In this embodiment of the bottom structure, if the leg portion is raised by the leg portion raising mechanism, the support arm (6) is pivotally rotated to rise, causing the respective parallel strips (5) to be brought into mutual contact on the under side, thus causing the leg portion (4) to bend and protrude upward. As a result, the leg portion (4) is generally bent at a large radius of curvature (8). Therefore, even if the protruding top does not suit the knee position of the patient, the knees are still kept from experiencing pressure, and the patient does not feel any discomfort.

Figure 3:
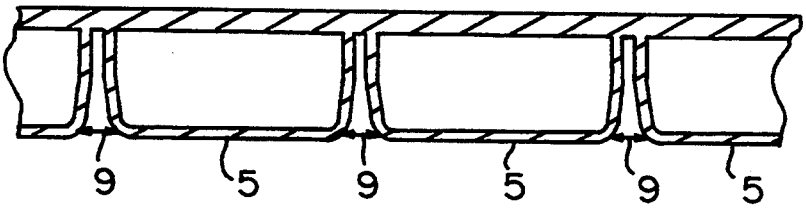
FIG. 3 is an enlarged side view showing a cross section of the bottom of another embodiment.

In another embodiment of the present invention, the parallel strips (5) are formed in a trapezoidal shape only at the lower halves of the strips in cross section as shown in FIG. 3. In this embodiment, the gaps (9) formed between the respectively adjacent parallel strips (5) allow the leg portion to be bent generally at a large curvature by leg portion raising, and thus the bed is especially suitable for tall patients.

Since the leg portion (4) is preferably formed by thermoplastic molding of hollow strips, it can be easily prepared, is simply in structure, and economically advantageous in view of the reduced cost to manufacture.

As described above, the present invention can provide a bed highly adaptable for patients of various body sizes.

As shown in FIG. 4, another embodiment of the bed (11) has parallel strips (13) as parts of the bottom (12) at the portion corresponding approximately to the waist of the patient, to allow bending of the bottom. The strips are connected with each other on the under side. Each of the strips (13) is shorter in width on the upper side than on the under side.

The bottom (12) has preferably five parallel strips (13) formed preferably of thermoplastic molding of hollow strips. The parallel strips (13), as shown in FIG. 5, are almost trapezoidal in cross section and are sequentially connected on the under side, with gaps (17) formed at an angle of preferably about 16 degrees between the respectively adjacent opposite faces of the parallel strips (13). Under the bottom (12), a back raising mechanism (14) for bending the bottom (12) through a support arm (15) may be provided.

In this bottom structure, if the back raising mechanism (14) is driven for raising the back portion, the support arm (15) is pivotally rotated to a raising position, causing the respective parallel strips (13) to be brought into mutual contact on their upper side, to bend the bottom upward at a large curvature (radius of curvature (18)). As a result, the bottom (12) can be bent upward to an angle of about 80 degrees, to secure a proper space around the waist of the patient, which eases the feeling of pressure caused by raising the back portion.

The present invention can also be provided with parallel strips (13) formed to be trapezoidal in cross section only at approximately the upper half of the strips as shown in FIG. 6.

Also in this modification, since gaps (19) are formed between the respective parallel strips (13) on the upper side on the bottom, the back raising action makes the bottom bent upward, generally in a large curvature, to secure a moderate space around the waist of the patient. This bed bottom can be especially suitable for tall patients.

Since the bottom (12) is preferably formed of thermoplastic molding of hollow strips, it can be easily prepared, is simple in structure, and thus economically advantageous in view of the cost to manufacture. As described above, the present invention provides a comfortable bed designed to ease the feeling of pressure caused by raising the back portion.

In the bottom structures, as shown in FIGS. 4 to 6, the gaps formed by the bottom structure are on the top and next to the bedding material. When the bottom structure is bent, the mattress (20) placed on the bottom, may become caught between the parallel strips. FIG. 9 shows how mattress or bedding material (20) can be caught in the gaps of the bottom structure when bent. FIG. 9 includes an enlarged view of material caught in a gap.

To prevent this, it is preferable to cover the bottom structure with a flexible sheet (21). The flexible sheet (21) may cover the entire structure as shown in FIG. 7, or be laid on top of the structure as shown in FIG. 8. FIG. 8 includes an enlarged view of one means (22) for connecting the flexible sheet to the bottom structure. In this method of attachment, the flexible sheet is attached directly (22) to the bottom structure at the end of the structure.

Also, in the embodiments shown in FIGS. 4 to 6, the gaps formed on the upper side can collect dust and dirt. However, when the structures are covered with a flexible sheet, dust and dirt can not collect in the gaps. Furthermore, the flexible sheet is easily cleaned, improving the health and safety of the patient. The sheet also prevents any other objects from being caught in the gaps and impairing the function of the bottom structure.

The above particular embodiments have been described for the purpose of illustration of the invention. It is to be understood that these embodiments and other variations and modifications are within the spirit of the invention and the invention is not to be taken as limited except by the scope of the appended claims.

What is claimed is:

1. A bottom structure of a bed comprising a bottom being formed to be bendable by a series of parallel strips mutually sequentially connected on one side, wherein said strips are shorter in width on another side opposite the one side which is connected, wherein said one side of the series of parallel strips are connected on an under side and form a section of the bed structure which is to be bent forming a large curvature above a plane of the bed.

2. A bottom structure of a bed according to claim 1, wherein said section of said bed structure is a back portion.

3. A bottom structure of a bed according to claim 1, wherein said section of said bed structure is a waist portion.

4. A bottom structure of a bed according to claim 3, further comprising a back section raising mechanism.

5. A bottom of a bed according to claim 4, wherein said bottom structure can be bent upward to an angle of about 80 degrees.

6. A bottom structure of a bed according to claim 1, wherein said parallel strips are substantially trapezoidal in cross section.

7. A bottom structure of a bed according to claim 6, wherein a gap is formed between parallel strips at an unconnected shorter side forming an angle between side walls of the strips of about 16 degrees.

8. A bottom structure of a bed according to claim 1 wherein said parallel strips have a trapezoidal shapes only at about a lower half of the strips.

9. A bottom structure of a bed according to claim 1 further comprising a flexible sheet.

10. A bottom structure of a bed according to claim 9, wherein said sheet covers the entire bottom structure.

11. A bottom structure of a bed according to claim 9, wherein said sheet covers a top side of the bottom structure.

12. A bottom structure of a bed according to claim 11, wherein said sheet is attached to and covers a top side of the bottom structure and is attached at an end of the structure.

13. A bottom structure of a bed comprising a bottom being formed to be bendable by a series of parallel strips mutually sequentially connected on one side, wherein said strips are shorter in width on another side opposite the one side which is connected, wherein said one side of the series of parallel strips are connected on an under side thereof and form a part of the bed structure which is to be bent forming a large curvature below a plane of the bed, and a series of strips connected on an upper side thereof and which form a section of the bed structure which is to be bent forming a large curvature above a plane of the bed.

14. A bottom structure of a bed comprising a bottom being formed to be bendable by a series of parallel strips mutually sequentially connected on one side, wherein said strips are shorter in width on another side opposite the one side which is connected, said series of parallel strips being connected on an upper side and forming a portion of said bed which is to be bent forming a large curvature below a plane of the said bed, and further comprising a series of parallel strips which are connected on an under side and form a part of the bed section which is to be bent forming a large curvature above a plane of the bed.

15. A bottom structure of a bed comprising a bottom being formed to be bendable by a series of parallel strips mutually sequentially connected on one side, wherein said strips are shorter in width on another side opposite the one side which is connected, said series of parallel strips being connected on an upper side and forming a portion of said bed which is to be forming a large curvature below a plane of the bed, wherein said parallel strips have a trapezoidal shapes only at about a lower half of the strips.

* * * * *